US008789827B2

(12) United States Patent
Karikusa

(10) Patent No.: US 8,789,827 B2
(45) Date of Patent: Jul. 29, 2014

(54) SHEET CONVEYING DEVICE, IMAGE READING DEVICE, AND IMAGE FORMING APPARATUS

(71) Applicant: Yuji Karikusa, Ibaraki (JP)

(72) Inventor: Yuji Karikusa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/909,367

(22) Filed: Jun. 4, 2013

(65) Prior Publication Data

US 2013/0341852 A1 Dec. 26, 2013

(30) Foreign Application Priority Data

Jun. 22, 2012 (JP) ..... 2012-141201

(51) Int. Cl.
*B65H 9/04* (2006.01)

(52) U.S. Cl.
USPC ..... 271/246; 271/245

(58) Field of Classification Search
USPC ..... 271/242, 245, 246
See application file for complete search history.

(56) References Cited

U.S. PATENT DOCUMENTS

| | | | |
|---|---|---|---|
| 2008/0054553 | A1 | 3/2008 | Muneyasu et al. |
| 2008/0251998 | A1 | 10/2008 | Muneyasu et al. |

FOREIGN PATENT DOCUMENTS

| | | |
|---|---|---|
| JP | 3-094275 | 4/1991 |
| JP | 8-081089 | 3/1996 |
| JP | 8-225195 | 9/1996 |
| JP | 8-295439 | 11/1996 |
| JP | 10-175752 | 6/1998 |
| JP | 11-020993 | 1/1999 |
| JP | 11-030884 | 2/1999 |
| JP | 2002-128326 | 5/2002 |
| JP | 2002-193491 | 7/2002 |
| JP | 2002-265100 | 9/2002 |
| JP | 2005-306608 | 11/2005 |
| JP | 2008-001473 | 1/2008 |
| JP | 2008-050069 | 3/2008 |
| JP | 2008-074620 | 4/2008 |
| JP | 2008-120561 | 5/2008 |
| JP | 2008-184259 | 8/2008 |
| JP | 2008-254856 | 10/2008 |
| JP | 2010-024053 | 2/2010 |
| JP | 2010-143662 | 7/2010 |
| JP | 2010-143708 | 7/2010 |
| JP | 2010-168208 | 8/2010 |
| JP | 2011-006232 | 1/2011 |
| JP | 2011-219265 | 11/2011 |

OTHER PUBLICATIONS

Machine Translation of JP 2002-265100.*

* cited by examiner

*Primary Examiner* — Michael McCullough
(74) *Attorney, Agent, or Firm* — Cooper & Dunham LLP

(57) ABSTRACT

A sheet conveying device includes a pair of upstream sheet conveying rollers, a pair of downstream sheet conveying rollers, and a gate unit including multiple striking faces disposed adjacent to the pair of downstream sheet conveying rollers. The gate unit is enabled to enter and evacuate from a sheet conveyance path. A skew correction control mechanism is provided to correct skew by bringing the gate unit into the sheet conveyance path to cause the striking faces to collide with a leading end of the sheet with the skew while rotating the pair of upstream sheet conveying rollers. One or more rollers are included in one of the pair of upstream sheet conveying rollers and are disposed in the vicinity of a widthwise center of the sheet conveyance path. A width of one or more rollers is smaller than a widthwise interval between the multiple striking faces.

13 Claims, 8 Drawing Sheets

SHEET CONVEYING DEVICE, IMAGE READING DEVICE, AND IMAGE FORMING APPARATUS

CROSS-REFERENCE TO RELATED APPLICATION

This patent application is based on and claims priority pursuant to 35 U.S.C. §119 to Japanese Patent Application No. 2012-141201, filed on Jun. 22, 2012 in the Japan Patent Office, the entire disclosure of which is hereby incorporated by reference herein.

BACKGROUND

1. Technical Field

The present invention relates to a sheet conveying device provided in a sheet conveying system, an image reading device including the sheet conveying system, and an image forming apparatus including the sheet conveying system or the like. In particular, the present invention relates to a skew correcting device employed in one of the sheet conveying system, the image reading device, and the image forming apparatus or the like suitable for correcting skew of a thin sheet.

2. Related Art

In various types of image forming apparatuses, such as copiers, printers, facsimiles etc., and an image reading device, such as a scanner, etc., an image formation unit and/or an image reading unit are installed in the apparatus and device. In such an apparatus and device, by conveying a sheet, such as a plain paper sheet, etc., through the image formation unit, a desired image is formed on the sheet. Similarly, by conveying a sheet as an original document with recorded image information thereon through the image reading unit in such a device, the image information on the sheet is optically read.

In the conventional image forming apparatus and image reading device, to properly form an image or read the image information, skew of the sheet is corrected just before respective positions of the image reading unit and the image formation unit in a sheet conveyance direction to adjust a posture and a position of the sheet.

As a sheet conveying device that corrects the skew of the sheet, a roller nip collision system is known, in which a leading end of a sheet collides with a pair of nip forming rollers that stop rotation to bend the sheet and cause the leading end to fit along a roller nip formed between the pair of nip forming rollers by its elasticity.

Otherwise, a gate collision system is provided to correct the skew of the sheet. Specifically, a gate unit capable of entering or evacuating from a sheet conveyance path is provided to stop the sheet and cause the leading end thereof to fit along a gate member. The gate member evacuates from the sheet conveyance path after fitting of the leading end and thereby correcting the skew of the sheet.

However, in the roller nip collision system, such sheet skew correction performance depends on the bending of the sheet. In addition, the number of rollers installed and the spacing of the rollers to form the bending the sheet are limited by the maximum sheet width that the image forming apparatus can handle.

By contrast, in the gate collision system, when the leading end of the sheet collides with a sheet striking member (e.g. the gate), since it is sandwiched, and accordingly restricted at the nip formed between the pair of opposed conveyance rollers, the sheet rarely rotates on a horizontal plane to correct its skew. Accordingly, a degree of freedom to correct a position of the leading end of the sheet is relatively low, and accordingly, a small amount of the skew of the sheet can be corrected. As a result, an image is either diagonally formed or read resulting in inaccurate recording or reading.

Then, in the past, various sheet skew correction technologies are proposed as discussed, for example, in Japanese Patent Application Publication Nos. JP-2002-265100-A, JP-2002-128326-A, and JP-H08-081089-A or the like.

For example, JP-2002-265100-A discloses a technology, in which a pair of roller pieces is disposed at a widthwise center of a sheet to bend the sheet while reducing restriction force applied to the sheet and improving a skew correction function during a skew correction process, thereby upgrading recording accuracy.

Further, JP-2002-128326-A and JP-H08-081089-A also disclose technologies, in which a spherical roller is employed to bend the sheet while further reducing the restriction force applied to the sheet, thereby preventing stains and wrinkles possibly generated in the sheet.

However, with such conventional skew correction technologies, an especially thin sheet having a thickness of about 55 gsm (gram per square meter: $g/m^2$) wrinkles at its leading end during a skew correction process.

That is, with the gate collision system of JP-2002-128326-A or the like as shown in FIG. 10A in which a reference sign H indicates a width of a sheet 4, since a relation between a widthwise interval L between multiple gate members 1 and 1 disposed in an axial direction and a width W of a pair of roller pieces 3 of a conveyor roller 2 in the same direction is represented by an inequality ($L<W$), a pushing force is generated to push the leading end of the sheet 4 outside the gate members 1 so that sheet buckling 5 and wrinkles 6 are generated sometimes as shown in FIGS. 10B and 10C, respectively. The above-described sheet buckling 5 and wrinkles 6 are likely generated especially when a thin sheet having a thickness of less than about 55 gsm or the like is used.

Similarly, with the system of JP-H08-081089-A shown in FIG. 11, the skew is corrected by bringing a leading end of the sheet 4 to a nip 7 formed between a pair of sheet conveying rollers 2 and rotating the sheet 4 in a prescribed direction 8 regarding the nip as a rotation axis to collide with the nip 7. Therefore, distortion and/or wrinkles 6 are generated at the leading end of the sheet 4.

SUMMARY

Accordingly, the present invention provides a novel sheet conveying device that includes a sheet conveying guide disposed on a portion of a sheet conveyance path to guide a sheet; a pair of upstream sheet conveying rollers disposed upstream in the sheet conveyance path in a sheet conveyance direction; and a pair of downstream sheet conveying rollers disposed downstream of the pair of upstream side sheet conveying rollers in the sheet conveyance direction. A gate unit is located adjacent to the pair of downstream sheet conveying rollers and includes at least two striking faces divided perpendicular to the sheet conveyance direction. The gate unit is enabled to enter and evacuate from the sheet conveyance path. A skew correction control mechanism is provided to correct skew by bringing the gate unit to the sheet conveyance path to cause the striking face to collide with a leading end of the sheet coming with skew while rotating the pair of upstream sheet conveying rollers. At least one roller is included in one of the pair of upstream sheet conveying rollers and is disposed in the vicinity of a center of the sheet conveyance path. A width W of the at least one roller in its widthwise direction is smaller than a widthwise interval L between the at least two striking faces of the gate unit (i.e., W<L).

In another aspect of the present invention, an image forming apparatus employs an image formation unit and a sheet conveying device that includes a sheet conveying guide disposed on a portion of a sheet conveyance path to guide a sheet; a pair of upstream sheet conveying rollers disposed upstream in the sheet conveyance path in a sheet conveyance direction; and a pair of downstream sheet conveying rollers disposed downstream of the pair of upstream side sheet conveying rollers in the sheet conveyance direction. A gate unit is located adjacent to the pair of downstream sheet conveying rollers and includes at least two striking faces divided perpendicular to the sheet conveyance direction. The gate unit is enabled to enter and evacuate from the sheet conveyance path. A skew correction control mechanism is provided to correct skew by bringing the gate unit to the sheet conveyance path to cause the striking face to collide with a leading end of the sheet coming with skew while rotating the pair of upstream sheet conveying rollers. At least one roller is included in one of the pair of upstream sheet conveying rollers and is disposed in the vicinity of a center of the sheet conveyance path. A width W of the at least one roller in its widthwise direction is smaller than a widthwise interval L between the at least two striking faces of the gate members (i.e., W<L).

In yet another aspect of the present invention, an image reading device employs an original document conveying device. The original document conveying device includes an original document conveying guide disposed in an original document conveying path to guide original document; a pair of upstream original document conveying rollers disposed upstream of the original document conveying guide in an original document conveying direction in the original document conveying path; and a pair of downstream original document conveying rollers disposed downstream of the pair of upstream side original document conveying rollers in the original document conveying direction. A gate unit is located adjacent to the pair of downstream original document conveying rollers and includes multiple striking faces divided perpendicular to the original document conveying direction. The gate unit is enabled to enter and evacuate from the original document conveying path. A skew correction control mechanism is provided to connect skew by bringing the gate unit into the original document conveying path to cause the striking face to collide with a leading end of the original document coming with the skew while rotating the pair of upstream original document conveying rollers. More than one roller is included in one of the pair of upstream original document conveying rollers and is disposed in the vicinity of a widthwise center of the original document conveying path. A width W of the roller in its widthwise direction is smaller than a widthwise interval L between the multiple striking faces of the gate unit (i.e., W<L).

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
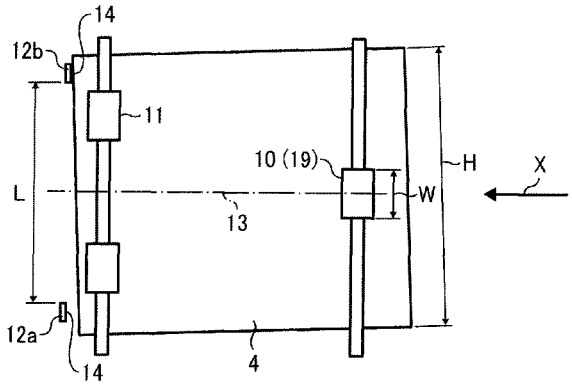
FIG. 1 is a schematic plan view schematically illustrating a configuration of a sheet conveying device according to a first embodiment of the present invention.
Figure 2:
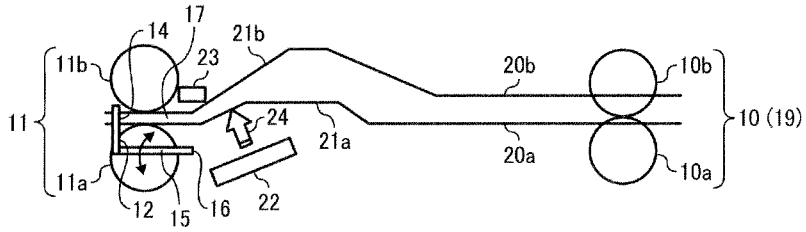
FIG. 2 is a schematic cross-sectional view schematically illustrating the configuration of the sheet conveying device according to the first embodiment of the present invention.

Referring now to the drawings, wherein like reference numerals designate identical or corresponding parts throughout the several views thereof and in particular to FIGS. 1 and 2, an exemplary sheet conveying device according to one embodiment of the present invention is described. FIG. 1 is a schematic plan view illustrating a configuration of the sheet conveying device. By contrast, FIG. 2 is a cross-sectional view schematically illustrating the configuration of the sheet conveying device.

The sheet conveying device according to one embodiment of the present invention is disposed in a sheet conveyance path that leads a sheet 4 in a direction as shown by arrow X in FIG. 1. The sheet conveying device includes a pair of upstream sheet conveying rollers 10 that conveys the sheet 4, such as a printing sheet, etc., a pair of downstream sheet conveying rollers 11 disposed downstream of the pair of upstream sheet conveying rollers 10 in a sheet conveyance direction X, and a pair of gate members 12*a* and 12*b* disposed further downstream of the pair of downstream sheet conveying rollers 11 in the sheet conveyance direction X that together form a gate unit 12.

As shown in FIG. 2, upper and lower roller pieces 10*a* and 10*b* constituting the above-described pair of upstream sheet conveying rollers 10 are continuously pressed against each other. By contrast, a pair of upper and lower roller pieces 11*a* and 11*b* constituting the above-described pair of downstream sheet conveying rollers 11 are enabled to either engage or disengage from each other under control of an engaging/disengaging system (not shown).

The gate unit 12 is divided into a pair of gate members 12*a* and 12*b* as arranged in a direction perpendicular to the sheet conveyance direction X in this embodiment as shown in FIG. 1. These gates 12*a* and 12*b* are symmetrically disposed about a centerline 13 of the sheet conveyance path in a plan view.

In the first embodiment, a pair of striking faces 14 and 14 of the pair of gate members 12*a* and 12*b* is located downstream of a nip of the pair of downstream sheet conveying rollers 11 as shown in FIG. 2. Thus, when a gate evacuating member 15 swings around its rear anchor 16, the pair of striking faces 14 and 14 of the pair of gate members 12*a* and 12*b* can either enter or evacuate from the sheet conveyance path 17.

In the first embodiment, a pair of striking faces 14 and 14 of the pair of gate members 12*a* and 12*b* is located downstream of a nip of the pair of downstream sheet conveying rollers 11 as shown in FIG. 2. Thus, when the gate evacuating member 15 swings around its rear anchor 16, the pair of striking faces 14 and 14 of the pair of gate members 12*a* and 12*b* can either enter or evacuate from the sheet conveyance path 17. Each of such a pair of gate members 12*a* and 12*b* is attached to a leading end of the gate evacuating member 15.

Although a swingable gate evacuating member 15 is employed as a gate evacuating mechanism in this embodiment, the pair of gate members 12*a* and 12*b* can be moved up and down from the sheet conveyance path 17 to enable the pair of striking faces 14 and 14 thereof to either enter or evacuate from the sheet conveyance path 17.

In either case, as in this embodiment, when the pair of striking faces 14 and 14 of the pair of gate members 12*a* and 12*b* is located downstream of the nip of the pair of downstream sheet conveying rollers 11, the rollers 11*b* and 11*a* collectively constituting the pair of downstream sheet conveying rollers 11 are enabled to either engage or disengage from each other.

Figure 3:
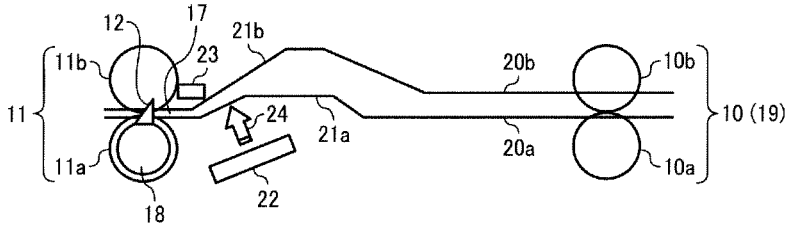
FIG. 3 is a cross-sectional view schematically illustrating a configuration of the sheet conveying device according to a second embodiment of the present invention.

FIG. 3 is a cross-sectional view schematically illustrating a configuration of the sheet conveying device according to a second embodiment of the present invention. The difference between this embodiment and the first embodiment is the configuration of the pair of gate members 12*a* and 12*b* and its surroundings.

As shown in FIG. 3, in one embodiment of the present invention, the pair of striking faces 14 and 14 of the pair of gate members 12*a* and 12*b* is located upstream than the nip of the pair of downstream sheet conveying rollers 11*a* and 11*b* in the sheet conveyance direction X.

Each of the pair of gate members 12*a* and 12*b* is fixed to a periphery of the gate moving roller 18. The gate moving roller 18 is coaxially located on a concentric circle with a lower side roller 11*a* of the pair of downstream sheet conveying rollers. Thus, when the gate moving roller 18 rotates by a given angle, the pair of striking faces 14 and 14 of the pair of gate members 12*a* and 12*b* can either enter or evacuate from the sheet conveyance path 17.

When the pair of striking faces 14 and 14 of the pair of gate members 12*a* and 12*b* is located upstream of the nip of the pair of downstream sheet conveying rollers in the sheet conveyance direction X as in this embodiment, the pair of roller pieces 11*a* and 11*b* constituting the pair of downstream sheet conveying rollers 11 may be substantially frequently pressed against each other.

In such a situation, as shown in FIG. 1, in both of the first and second embodiments, a roller 19 is included in the pair of the upstream sheet conveying rollers 10 and is located at a widthwise center line 13 of its shaft and that in the sheet conveyance path. Further, a width W of the roller 19 of the pair of sheet conveying rollers 10 in its axial direction is smaller enough than a widthwise interval L between the pair of striking faces 14 and 14 of the pair of gate members 12*a* and 12*b*, so that the relation L>W can be established.

Further, the widthwise interval L between the striking faces 14 and 14 of the pair of gate members 12*a* and 12*b* is set smaller than a lateral width H of a minimum usage sheet 4 to meet the inequality (H>L) in order to enable the sheet 4 to collide with both of the striking faces 14 and 14 even when the maximum skew of the sheet 4 occurs therein. That is, the relation H>L>W is established as a whole.

As shown in FIGS. 2 and 3, a pair of upper and lower guide plates 20*a* and 20*b* is extended almost in parallel to each other along a conveyance path starting from the pair of upstream sheet conveying rollers ending at the pair of downstream sheet conveying rollers 11 to guide and convey the sheet 4. A sheet conveyance path 17 is accordingly formed between pair of upper and lower guide plates 20*a* and 20*b*.

A pair of bent or curved sheet bending sections 21*a* and 21*b* is provided in the upper and lower guide plates 20*a* and 20*b*, respectively, just before the pair of gate members 12*a* and 12*b* in the sheet conveyance direction X to bend the sheet 4 in a loop forming direction.

A blower type fan (i.e., a blower) 22 is installed below the sheet bending section 21*a* of the lower guide plate 20*a* while facing a lower side of the sheet 4 conveyed thereto. Further, an optical sheet sensor 23, for example, is disposed slightly upstream of the pair of gate members 12*a* and 12*b*, preferably at a widthwise center of the sheet 4 coming close to the gate members 12 to detect a leading end of the sheet 4 and turns on/off the blower 22.

Now, an exemplary function of the sheet conveying device is described herein below. Specifically, as shown in FIG. 2, in the first embodiment, the upper and lower side rollers 11*a* and 11*b* separate from each other by a prescribed length to accept the sheet 4 to pass before skew correction is applied to the sheet 4. Subsequently, the pair of striking faces 14 and 14 of the pair of gate members 12*a* and 12*b* is located downstream of the nip of the pair of downstream sheet conveying rollers 11 in the sheet conveyance path 17.

By contrast, in the second embodiment, the pair of downstream sheet conveying rollers 11 keeps contacting each other with pressure as shown in FIG. 3, and the pair of striking faces 14 and 14 of the pair of gate members 12*a* and 12*b* is located upstream of the nip of the pair of downstream sheet conveying rollers 11 in the sheet conveyance path 17.

Accordingly, the sheet 4 sandwiched between the pair of upstream sheet conveying rollers 10 is conveyed toward the pair of downstream sheet conveying rollers 11 across the sheet conveyance path 17 formed between the upper and lower guide plates 20*a* and 20*b*.

When the sheet sensor 23 detects the leading end of the sheet 4 and outputs a detection signal when it comes close to the pair of guide plates 20*a* and 20*b* of the sheet bending divisions 21*a* and 21*b*. Subsequently, a control unit (not shown) outputs a driving signal based on the detection signal and drives the blower 22. In this example, the sheet sensor 23 is disposed downstream of an air blowing section of the blower 22 in the sheet conveyance direction as shown in FIG. 3.

Figure 4:
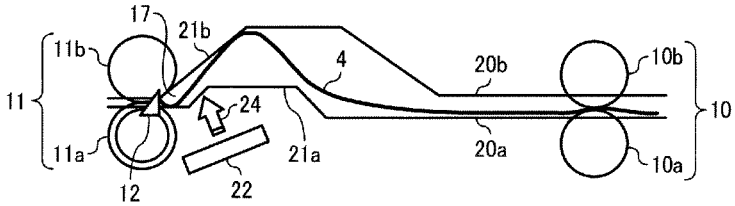
FIG. 4 is a cross-sectional view schematically illustrating an aspect when a sheet is blown by a blower to fit a sheet bending unit provided in an upper guide plate in the sheet conveying device according to the second embodiment of the present invention.

The blower 22 blows air 24 toward the sheet bending section 21*a* of the lower guide plate 20*a*. Although not shown in the drawing, multiple numbers of slender air blowing slits or pores are formed being extended in the sheet conveyance direction X in the sheet bending section 21*a*. Accordingly, the sheet 4 can be conveyed fitting the sheet bending section 21*b* of the upper guide plate 20*b* as shown in FIG. 4. Hence, the leading end of the sheet 4 can be prevented from bending in an opposite direction to the loop forming direction.

Further, the blower 22 is preferably turned off when the leading end of the sheet 4 is expected to engage with the pair of striking faces 14 and 14. Specifically, a time period from when the leading end of the sheet 4 with maximum sheet skew is detected by the sheet sensor 23 to when it hits the pair of striking faces 14 and 14 is sought beforehand and the blower stops its operation at the time, sheet skew can be smoothly corrected.

In addition, arrangement of these blower 22 and sheet sensor 23 is not limited to that as described above. Specifically, the blower can be turned on before the sheet sensor 23 detects the sheet 4 conveyed thereto and is turned off timely thereafter (e.g. a time when the leading end of the sheet 4 is expected to engage with the pair of striking faces 14 and 14).

FIG. 4 illustrates an aspect of the sheet conveying device according to the second embodiment of the present invention.

Figure 5A:
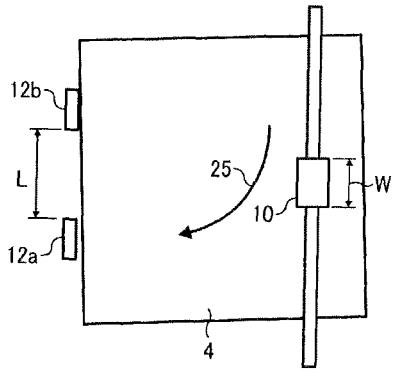
FIG. 5A is a plan view illustrating exemplary sheet skew correction executed in one embodiment of the present invention.
Figure 5B:
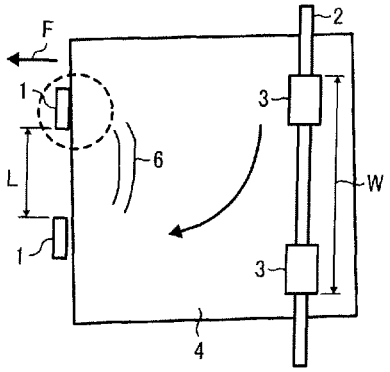
FIG. 5B RELATED ART
FIG. 5B is a plan view illustrating conventional sheet skew correction.

FIG. 5A is a plan view illustrating skew correction applied to the sheet 4 in this embodiment of the present invention. FIG. 5B is a plan view illustrating conventional skew correction applied to the sheet 4 as shown in the FIG. 9.

In a state shown in FIG. 4, the pair of upstream sheet conveying rollers 10 causes the sheet 4 to collide with the pair of striking faces 14 and 14 of the pair of gate members 12*a* and 12*b* and form a loop therein to correct skew of the sheet 4. At this moment, when it is supposed that the sheet 4 is conveyed with skew and the loop is formed as shown in FIG. 5A, for example, since a roller piece of the pair of upstream conveyor rollers 10 is disposed on or adjacent to the center line 13 of the sheet conveyance path, a prescribed amount of force 25 operates clockwise onto the sheet 4 regarding the sheet conveyance direction. Specifically, the force 25 occurs to direct the leading end of the sheet 4 not engaging yet with it toward the gate member 12*a* with the gate member 12*b* already engaging with the sheet 4. Thus, skews of the sheet 4 can be corrected.

As shown in FIG. 5A, in the sheet conveying device according to this embodiment of the present invention, because a width W of the roller piece of the pair of upstream sheet conveying rollers 10 in an axial direction is smaller than the widthwise interval L between the pair of gate members 12*a* and 12*b* (i.e., W<L), the rotational force is simply generated and applied to the sheet 4, so that wrinkles substantially do not appear thereon. Furthermore, even when a thin sheet, especially that having a thickness of less than about 55 gsm is used and a loop thereof is formed, for example, force is simply applied to the sheet 4 to press it against the pair of gate members 12*a* and 12*b* by the roller pieces of the pair of sheet conveying rollers 10, which are disposed at a sheet conveyance widthwise center (i.e., a position suitable to correct the skew of the sheet). Thus, wrinkles do not occur at the leading end of the sheet 4.

By contrast, as shown in FIG. 5B, in a conventional sheet conveying device, since a width W of roller pieces 3 of one of the pair of sheet conveying rollers 2 in its axial direction is larger than the widthwise interval L of the gate members 1 and 1 (i.e., W>L), not only a rotational force but also pushing force F pushing the sheet 4 occur and are applied to the sheet 4 toward a rear side of the gate members 1. Accordingly, the sheet 4 is deformed thereby causing wrinkles 6 thereon.

Figure 6:
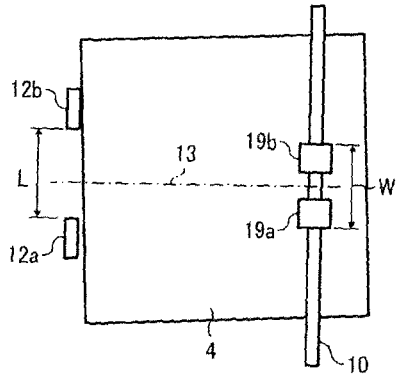
FIG. 6 is a schematic plan view illustrating a configuration of the sheet conveying device according to a third embodiment of the present invention.

FIG. 6 is a plan view illustrating an outline configuration of the sheet conveying device according to a third embodiment of the present invention. A difference of this embodiment from that first embodiment is a configuration of a pair of roller pieces of the upstream sheet conveying rollers 10.

As described earlier, the pair of upstream sheet conveying rollers 10 with a single roller 19 on a roller shaft is utilized in first embodiment. By contrast, in this embodiment, the pair of upstream sheet conveying rollers 10 includes a pair of roller pieces 19*a* and 19*b* on its roller shaft adjacent to the center of the sheet conveyance path 13. Further, also in this modification, a total width W of the pair of roller pieces 19*a* and 19*b* of the pair of upstream sheet conveying rollers 10 is set smaller than the widthwise interval L of the pair of gate members 12*a* and 12*b* (i.e., W<L).

Further, as shown in FIG. 6, when the pair of upstream sheet conveying rollers 10 including the pair of roller pieces 19*a* and 19*b* on the common roller shaft is utilized, the width W of the roller pieces 19*a* and 19*b* of the pair of upstream sheet conveying rollers 10 is defined by the sum of the width of each of the roller pieces 19*a* and 19*b* in its axial direction and a widthwise interval between the roller pieces 19*a* and 19*b* in this embodiment of the present invention.

Figure 7:
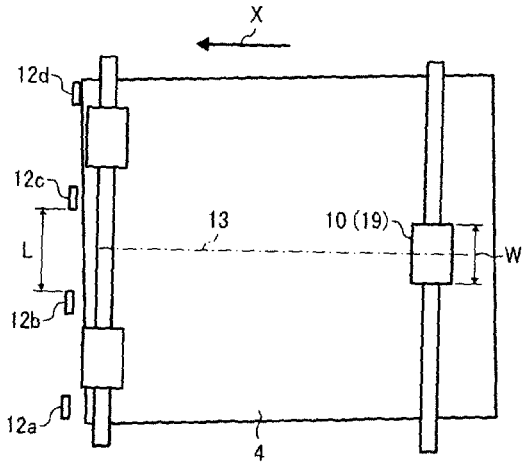
FIG. 7 is a plan view schematically illustrating a configuration of the sheet conveying device according to a fourth embodiment of the present invention.

FIG. 7 is a plan view illustrating a schematic configuration of the sheet conveying device according to a fourth embodiment of the present invention. A difference between this embodiment and the first embodiment is a configuration of the pair of gate members 12*a* and 12*b*.

Specifically, in the first embodiment of the present invention, the pair of gate members 12*a* and 12*b* are arranged perpendicular to the sheet conveyance direction X. By contrast, according to this embodiment, four gate members 12*a*, 12*b*, 12*c*, and 12*d* are located perpendicular to the sheet conveyance direction X, and a width W of a roller included in one of the pair of upstream sheet conveying rollers 10 in its axial direction is set smaller than the widthwise interval L between the gate members 12*b* and 12*c* (i.e., W<L) through which the center line 13 of the sheet conveyance path is extended.

As in the above-described embodiment, when presence of the coming sheet 4 is detected by the sheet sensor 23 disposed adjacent to the blower 22 and the blower 22 is controlled to be turned on/off based thereon, the blower 22 can effectively operate Further, the leading end of the sheet 4 can fit the sheet bending section 21*a* in the lower guide plate 20*a* using a suction type blower 22 and pressing the sheet 4 against the lower guide plate 20*a* with suction force. Further, the position of the blower is not limited to the above-described location, and may be a side of the sheet bending unit 21*b* of the upper guide plate, for example.

Figure 8:
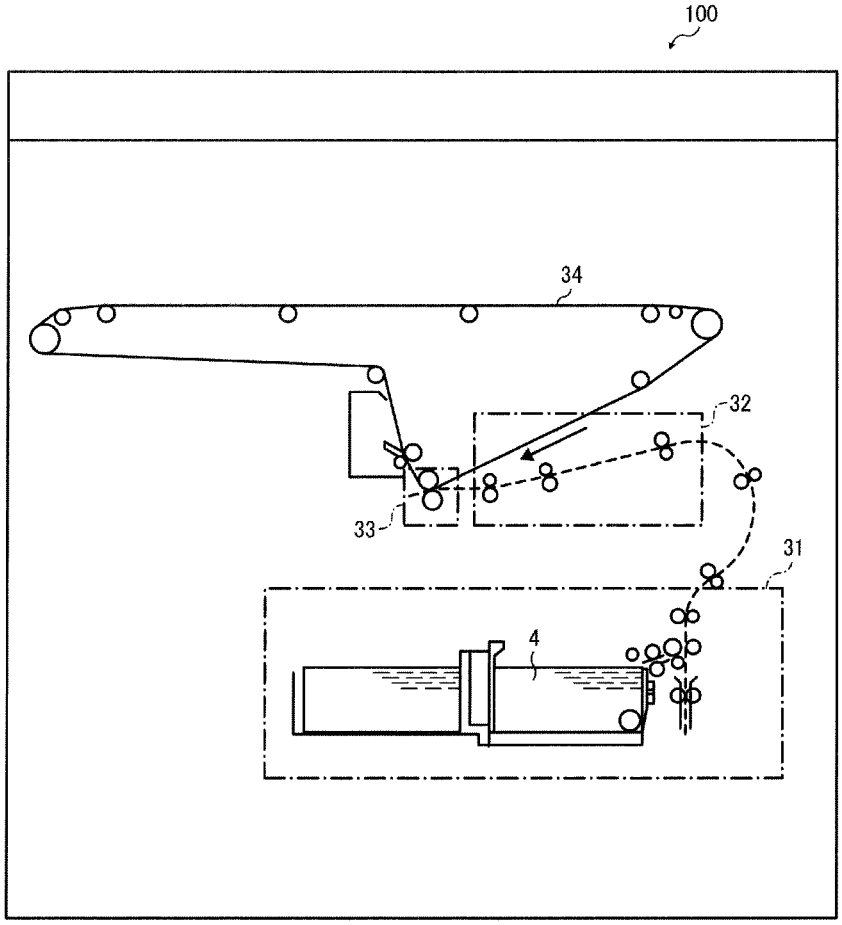
FIG. 8 is a block diagram schematically illustrating an image forming apparatus to which various embodiments of the present invention are applied.

FIG. 8 is a schematic block diagram illustrating an image forming apparatus 100 provided with the sheet conveying device 32 of one of the various embodiments of the present invention. Specifically, in the drawing, a reference code 31 denotes a sheet feeder accommodating multiple sheets 4 stacked, a reference code 32 denotes a sheet conveying system as described in one of the various embodiments, and a reference code 33 denotes a transfer device for transferring a toner image formed on a photoreceptor belt 34 onto the sheet 4.

Figure 9:
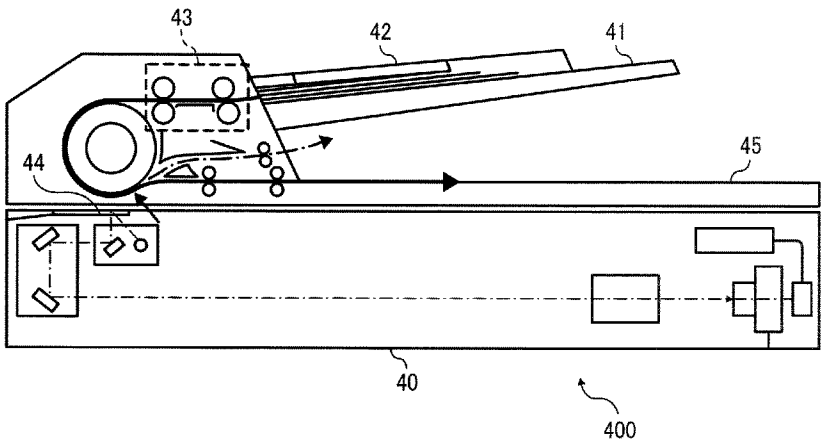
FIG. 9 is a block diagram schematically illustrating an image reading device to which various embodiments of the present invention are applied.
Figure 10A:
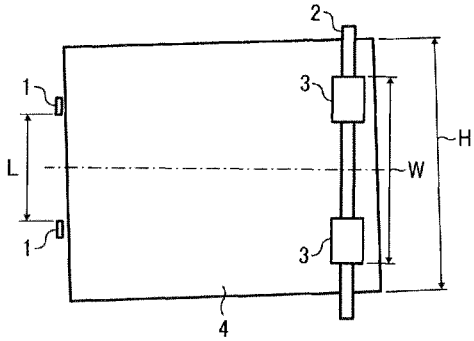
FIG. 10A RELATED ART
FIG. 10A is a diagram illustrating a relation between a widthwise interval L between a pair of gate members and a width W of roller pieces of a conventional sheet conveying device, which is aligned in an axial direction of the sheet conveying device.
Figure 10B:
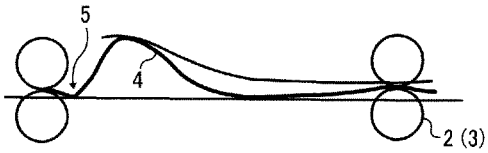
FIG. 10B RELATED ART
FIG. 10B is a cross-sectional view schematically illustrating an aspect of buckling caused at a leading end of a sheet during skew correction in the conventional sheet conveying device.
Figure 10C:
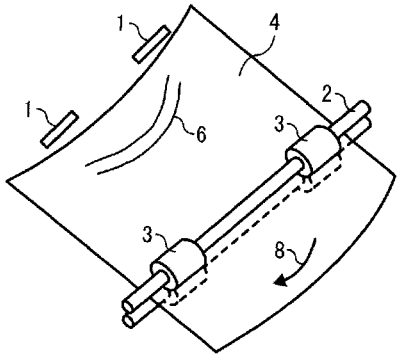
FIG. 10C RELATED ART
FIG. 10C is a perspective view schematically illustrating an aspect of wrinkles generated at a leading end of the sheet during the skew correction in the conventional sheet conveying device.
Figure 11:
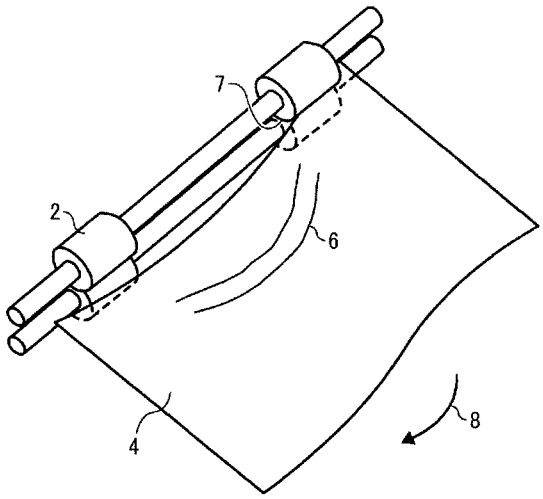
FIG. 11 RELATED ART
FIG. 11 is a perspective view schematically illustrating an aspect of wrinkles generated when a leading end of the sheet collides with a nip between the pair of sheet conveying roller pieces during skew correction in the conventional sheet conveying device.

Although the image forming apparatus with the sheet conveying device is described with reference to FIG. 8, the sheet conveying device 32 of one of the various embodiments of the present invention can be adopted into an image reading device as well as shown in FIG. 9.

Specifically, as shown there, an exemplary configuration of an image reading device 400 including an original document conveying unit 43 is provided. The original document conveying unit 43 includes the similar configuration to one of the sheet conveying devices 43 as employed in the above-described various embodiments, respectively. Specifically, in the drawing, a reference number 40 denotes a scanner unit equipped with a CCD (Charge Coupled Device) or the like, which optically reads an image described in an original document and converts and generates a digital signal based on a reading result. An original document loading tray 41 is provided to load the multiple original documents 42 thereon. An original document conveying unit 43 is provided and includes the similar configuration and function to that of the sheet conveying device 32 as employed in the above-described various embodiments. An original document reading section 44 is located downstream of the original document conveying unit 43, in which the image of the original document is optically read. An original document receiving tray 45 is also provided located downstream of the original document reading section 44 to receive the original documents ejected from the original document reading section 44 after optical reading thereof.

Thus, a posture and a feeding direction of the original document 42 with the skew are corrected in the original document conveying unit 43. As a result, the image in the original document is precisely read in the original document reading section 44. The original document is then ejected from the original document reading section 44 onto the original document receiving tray 45.

Hence, as described heretofore, according to one aspect of the present invention, an exemplary sheet conveying device can easily complete skew correction while reducing occurrence of wrinkles even in a thin sheet. Because, the exemplary sheet conveying device includes a sheet conveying guide disposed on a portion of a sheet conveyance path to guide a sheet, a pair of upstream sheet conveying rollers disposed upstream in the sheet conveyance path in a sheet conveyance direction, and a pair of downstream sheet conveying rollers disposed downstream of the pair of upstream side sheet conveying rollers in the sheet conveyance direction. A gate unit is located adjacent to the pair of downstream sheet conveying rollers and includes at least two striking faces divided perpendicular to the sheet conveyance direction. The gate unit is enabled to enter and evacuate from the sheet conveyance path. A skew correction control mechanism is provided to correct skew by bringing the gate unit into the sheet conveyance path to cause the striking face to collide with a leading end of the sheet coming with skew while rotating the pair of upstream sheet conveying rollers. At least one roller is included in one of the pair of upstream sheet conveying rollers and is disposed in the vicinity of a center of the sheet conveyance path. A width W of the at least one roller in its widthwise direction is smaller than a widthwise interval L between the at least two striking faces of the gate unit (i.e., $W<L$).

According to another aspect of the present invention, a sheet bending section is formed in the sheet conveying guide adjacent to the gate unit to bend the sheet in a loop forming direction. The sheet conveying guide is disposed between the gate unit and the pair of upstream sheet conveying rollers. In yet another aspect of the present invention, a blower is provided to blow air toward the sheet to fit a portion of the sheet into the sheet bending section, the blower facing one side of the sheet adjacent to the sheet bending section. Further, according to yet another aspect of the present invention, a vacuum to vacuum air to fit a portion of the sheet into the sheet bending section, the vacuum facing one side of the sheet adjacent to the sheet bending section. According to yet another aspect of the present invention, the pair of downstream sheet conveying rollers includes upper and lower rollers capable of engaging and disengaging with each other. The gate unit is disposed downstream of the pair of the downstream sheet conveying rollers in the sheet conveyance direction, and the upper and lower rollers separate from the other, and the striking face of the gate unit is disposed in the sheet conveyance path when sheet skew is corrected. According to yet another aspect of the present invention, upper and lower rollers of the pair of downstream sheet conveying rollers substantially frequently contact each other, and a striking face of the gate member is disposed in the sheet conveyance path upstream of a nip of the pair of downstream sheet conveying rollers in the sheet conveyance direction when the sheet skew is corrected. According to yet another aspect of the present invention, the pair of upstream sheet conveying rollers have at least one roller located substantially at a center of the sheet conveyance path, and the gate unit has a pair of left and right side symmetrical striking faces disposed about the center of the sheet conveyance path. According to yet another aspect of the present invention, a thickness of the sheet is less than about 55 gsm. According to yet another aspect of the present invention, an exemplary image reading device includes the above-described sheet conveying device. According to another aspect of the present invention, an exemplary image forming apparatus includes the above-described sheet conveying device.

Numerous additional modifications and variations of the present invention are possible in light of the above teachings. It is therefore to be understood that within the scope of the appended claims, the present invention may be executed otherwise than as specifically described herein.

What is claimed is:

1. A sheet conveying device comprising:

a sheet conveying guide disposed in a sheet conveyance path to guide a sheet;

a pair of upstream sheet conveying rollers disposed upstream of the sheet conveying guide in a sheet conveyance direction in the sheet conveyance path;

a pair of downstream sheet conveying rollers disposed downstream of the pair of upstream side sheet conveying rollers in the sheet conveyance direction;

a gate unit located adjacent to the pair of downstream sheet conveying rollers, the gate unit including at least two striking faces divided perpendicular to the sheet conveyance direction, the gate unit enabled to enter and evacuate from the sheet conveyance path;

a skew correction control mechanism to correct skew by bringing the gate unit into the sheet conveyance path to cause the at least two striking faces to collide with a leading end of the sheet coming with skew while rotating the pair of upstream sheet conveying rollers;

a sheet bending section formed adjacent to the gate unit in the sheet conveying guide to bend the sheet in a loop forming direction, wherein the sheet conveying guide is disposed between the gate unit and the pair of upstream sheet conveying rollers; and a fan facing one side of the sheet adjacent to the sheet bending section, the fan being a blower fan or a suction fan, to cause air flow to fit a portion of the sheet into the sheet bending section, wherein at least one roller included in one of the pair of upstream sheet conveying rollers is disposed in the vicinity of a widthwise center of the sheet conveyance path, the at least one roller having a width in its widthwise direction smaller than a widthwise interval between the at least two striking faces of the gate unit.

2. The sheet conveying device as claimed in claim 1, wherein the pair of downstream sheet conveying rollers includes upper and lower rollers capable of engaging and disengaging with each other, wherein the gate unit is disposed downstream of the pair of the downstream sheet conveying rollers in the sheet conveyance direction, wherein the upper and lower rollers separate from the other, and the at least two striking faces of the gate unit are disposed in the sheet conveyance path when sheet skew is corrected.

3. The sheet conveying device as claimed in claim 1, wherein upper and lower rollers of the pair of downstream sheet conveying rollers continuously contact each other at rest, and wherein the at least two striking faces of the gate unit are disposed upstream of a nip of the pair of downstream sheet conveying rollers in the sheet conveyance direction in the sheet conveyance path when skew of the sheet is corrected.

4. The sheet conveying device as claimed in claim 1, wherein at least one roller of the pair of upstream sheet conveying rollers is located substantially at a widthwise center of the sheet conveyance path, wherein the at least two striking faces of the gate unit include a pair of left and right side striking faces symmetrically disposed about the center of the sheet conveyance path.

5. The sheet conveying device as claimed in claim 1, wherein a thickness of the sheet is less than about 55 gsm.

6. An image reading device with a sheet conveying device, the sheet conveying device comprising:

a sheet conveying guide disposed in a sheet conveyance path to guide a sheet;

a pair of upstream sheet conveying rollers disposed upstream of the sheet conveying guide in a sheet conveyance direction in the sheet conveyance path;

a pair of downstream sheet conveying rollers disposed downstream of the pair of upstream side sheet conveying rollers in the sheet conveyance direction;

a gate unit located adjacent to the pair of downstream sheet conveying rollers, the gate unit including at least two striking faces divided perpendicular to the sheet conveyance direction, the gate unit enabled to enter and evacuate from the sheet conveyance path;

a skew correction control mechanism to correct skew by bringing the gate unit into the sheet conveyance path to cause the at least two striking faces to collide with a leading end of the sheet coming with skew while rotating the pair of upstream sheet conveying rollers;

a sheet bending section formed adjacent to the gate unit in the sheet conveying guide to bend the sheet in a loop forming direction, wherein the sheet conveying guide is disposed between the gate unit and the pair of upstream sheet conveying rollers; and a fan facing one side of the sheet adjacent to the sheet bending section, the fan being a blower fan or a suction fan, to cause air flow to fit a portion of the sheet into the sheet bending section, wherein at least one roller included in one of the pair of upstream sheet conveying rollers is disposed in the vicinity of a widthwise center of the sheet conveyance path, the at least one roller having a width in its widthwise direction smaller than a widthwise interval between the at least two striking faces of the gate unit.

7. The image reading device as claimed in claim 6, wherein the pair of downstream sheet conveying rollers includes upper and lower rollers capable of engaging and disengaging with each other, wherein the gate unit is disposed downstream of the pair of the downstream sheet conveying rollers in the sheet conveyance direction, wherein the upper and lower rollers separate from the other, and the at least two striking faces of the gate unit are disposed in the sheet conveyance path when sheet skew is corrected.

8. The image reading device as claimed in claim 6, wherein upper and lower rollers of the pair of downstream sheet conveying rollers continuously contact each other at rest, and wherein the at least two striking faces of the gate unit are disposed upstream of a nip of the pair of downstream sheet conveying rollers in the sheet conveyance direction in the sheet conveyance path when skew of the sheet is corrected.

9. The image reading device as claimed in claim 6, wherein at least one roller of the pair of upstream sheet conveying rollers is located substantially at a widthwise center of the sheet conveyance path, wherein the at least two striking faces of the gate unit include a pair of left and right side striking faces symmetrically disposed about the center of the sheet conveyance path.

10. The image reading device as claimed in claim 6, wherein a thickness of the sheet is less than about 55 gsm.

11. An image forming apparatus with a sheet conveying device, the sheet conveying device comprising:

a sheet conveying guide disposed in a sheet conveyance path to guide a sheet;

a pair of upstream sheet conveying rollers disposed upstream of the sheet conveying guide in a sheet conveyance direction in the sheet conveyance path;

a pair of downstream sheet conveying rollers disposed downstream of the pair of upstream side sheet conveying rollers in the sheet conveyance direction;

a gate unit located adjacent to the pair of downstream sheet conveying rollers, the gate unit including at least two striking faces divided perpendicular to the sheet conveyance direction, the gate unit enabled to enter and evacuate from the sheet conveyance path;

a skew correction control mechanism to correct skew by bringing the gate unit into the sheet conveyance path to cause the at least two striking faces to collide with a leading end of the sheet coming with skew while rotating the pair of upstream sheet conveying rollers;

a sheet bending section formed adjacent to the gate unit in the sheet conveying guide to bend the sheet in a loop forming direction, wherein the sheet conveying guide is disposed between the gate unit and the pair of upstream sheet conveying rollers; and a fan facing one side of the sheet adjacent to the sheet bending section, the fan being a blower fan or a suction fan, to cause air flow to fit a portion of the sheet into the sheet bending section, wherein at least one roller included in one of the pair of upstream sheet conveying rollers is disposed in the vicinity of a widthwise center of the sheet conveyance path, the at least one roller having a width in its widthwise direction smaller than a widthwise interval between the at least two striking faces of the gate unit.

12. The forming apparatus as claimed in claim 11, wherein the pair of downstream sheet conveying rollers includes upper and lower rollers capable of engaging and disengaging with each other, wherein the gate unit is disposed downstream of the pair of the downstream sheet conveying rollers in the sheet conveyance direction, and wherein the upper and lower rollers separate from the other, and the at least two striking faces of the gate unit are disposed in the sheet conveyance path when sheet skew is corrected.

13. The forming apparatus as claimed in claim 11, wherein upper and lower rollers of the pair of downstream sheet conveying rollers continuously contact each other at rest, and wherein the at least two striking faces of the gate unit are disposed upstream of a nip of the pair of downstream sheet conveying rollers in the sheet conveyance direction in the sheet conveyance path when skew of the sheet is corrected.

* * * * *